US009474346B2

(12) United States Patent
Simon

(10) Patent No.: US 9,474,346 B2
(45) Date of Patent: Oct. 25, 2016

(54) TRAY ASSEMBLY IN COMBINATION WITH A WHEELED LUGGAGE BAG HAVING A PAIR HANDLE STRUTS

(71) Applicant: David F. Simon, Lakeland, FL (US)

(72) Inventor: David F. Simon, Lakeland, FL (US)

( * ) Notice: Subject to any disclaimer, the term of this patent is extended or adjusted under 35 U.S.C. 154(b) by 0 days.

(21) Appl. No.: 14/807,950

(22) Filed: Jul. 24, 2015

(65) Prior Publication Data

US 2016/0022032 A1 Jan. 28, 2016

Related U.S. Application Data

(60) Provisional application No. 62/028,492, filed on Jul. 24, 2014.

(51) Int. Cl.
*A47B 23/00* (2006.01)
*A45C 13/28* (2006.01)

(52) U.S. Cl.
CPC ..... *A45C 13/28* (2013.01); *A45F 2200/0525* (2013.01)

(58) Field of Classification Search
CPC .. A47B 96/02; A47B 96/027; A47B 96/028; A47B 23/04; A47B 23/02
USPC ..... 108/42, 47, 48, 152, 108; 190/17, 13, 190/13 H, 15.1
See application file for complete search history.

(56) References Cited

U.S. PATENT DOCUMENTS 1,392,461 A * 10/1921 Struebing ..... B62B 9/28 248/230.9
2,423,635 A * 7/1947 Blum ..... A61H 3/02 135/66
2,649,972 A * 8/1953 Weil ..... A47F 5/13 108/108
2,984,443 A * 5/1961 Bergengren ..... A47B 97/08 108/152
3,097,884 A * 7/1963 Alford ..... A47C 7/68 108/152
3,187,692 A * 6/1965 Ross ..... A47B 5/04 108/134
3,403,878 A * 10/1968 Opay ..... B62J 7/06 224/420
3,740,012 A * 6/1973 Millen ..... A47B 96/061 248/201
5,188,089 A * 2/1993 Hamilton ..... A47J 37/0786 108/134
5,320,321 A * 6/1994 Muncada ..... B60N 3/005 248/443
D459,883 S * 7/2002 Worrell ..... D3/274
6,439,134 B1 * 8/2002 Ryburg ..... A45C 7/00 108/42
6,494,148 B1 * 12/2002 Mullaney ..... B60N 3/005 108/44
6,604,472 B2 * 8/2003 McNeil ..... A45C 13/00 108/152
6,736,073 B2 * 5/2004 Ryburg ..... A45C 7/00 108/42
7,448,688 B2 * 11/2008 Farah ..... A47C 16/02 108/47
7,821,779 B2 * 10/2010 Daley, III ..... G06F 1/1628 248/917
7,946,609 B2 * 5/2011 Johnson ..... A45C 5/14 280/47.19
7,950,335 B1 * 5/2011 Almond ..... A47B 23/001 108/152
8,079,312 B2 * 12/2011 Long ..... B60N 3/005 108/152
8,561,550 B2 * 10/2013 Raml ..... A47B 5/00 108/152
8,584,872 B2 * 11/2013 Eiseman ..... A47B 43/00 211/106
9,095,207 B2 * 8/2015 Schindler ..... A47B 5/02
2004/0226486 A1 * 11/2004 Simpson ..... A47B 5/00 108/47
2006/0162623 A1 * 7/2006 Ciulla ..... A47B 5/06 108/48
2010/0101459 A1 * 4/2010 Nelson ..... A47B 5/04 108/47

* cited by examiner

*Primary Examiner* — Jose V Chen
(74) *Attorney, Agent, or Firm* — John R. Benefiel

(57) ABSTRACT

A tray assembly able to be quickly installed and removed from the handle struts of a wheeled luggage bag by a mounting engaging the struts and a tray included in the tray assembly flipped down from the mounting to provide a horizontal support for various articles such as small electronic devices such as laptops, tablets, at a selected level above the top of the luggage bag. The tray is flipped back up to minimize the size of the tray assembly for convenient storage in the luggage back itself.

5 Claims, 7 Drawing Sheets

TRAY ASSEMBLY IN COMBINATION WITH A WHEELED LUGGAGE BAG HAVING A PAIR HANDLE STRUTS

CROSS REFERENCE TO RELATED APPLICATIONS

This application claims the benefit of U.S. provisional patent application No. 62/028,492 filed on Jul. 24, 2014.

BACKGROUND OF THE INVENTION

This application concerns accessories for wheeled luggage of a type that has a pair of spaced apart parallel struts which are vertically extendable from a retracted position to an elevated position well above the top of the bag to position an attached horizontal handle at a height convenient for pulling the luggage bag. The struts may be retracted to a stowed position with the handle held just above the top of the bag.

A person traveling with such a luggage bag typically spends substantial time in airports awaiting departure of a flight, and typically brings on the trip various personal electronic devices which are used during that time.

It would be convenient to have a support for such electronic devices particularly those which are larger such as tablets, digital readers, and larger sized smart phones. It also would be handy to have a place for other unpacked items such as beverage cans, phones, eyeglasses, etc. on the luggage bag so as to not be forgotten. Since wheeled luggage bags are designed to be stably positioned in an upright position, they could potentially be used as support for such items.

There have been many arrangements proposed for supporting beverage containers such as coffee travel mugs, etc. on such wheeled bags but these have not been useable for holding electronic devices such as tablets, smart phones, digital readers, etc., or most of the other items mentioned.

It has also been proposed to mount a large table top to a wheeled luggage bag, as described in U.S. Pat. No. 8,955,656.

Such a table provides a large area but is cumbersome and bulky to install.

Furthermore, the level of the table is limited to that of the top of the bag itself, and it would be advantageous to be able to sometimes provide a higher support for better viewing.

It would be very desirable to be able to quickly attach or remove such support without the use of tools or fasteners.

It is an object of the present invention to provide a tray assembly which is easy and quick to install and remove sufficiently and compact when removed from the luggage bag so as to be able to be conveniently stored in the luggage bag itself.

It is another object to provide such tray assembly which can be installed without the use of tools or needing separate attachment hardware.

SUMMARY OF THE INVENTION

The above recited objects and other objects which will be understood by those skilled in the art are achieved by a tray assembly which is able to be quickly mounted to or removed from a wheeled luggage bag at selected heights above the top of the luggage bag by a means of mounting arrangement which involves frictionally engaging the extended handle struts of the luggage bag at any desired level above the top of the bag itself. The tray is pivotable on the mounting arrangement so as to be able to fold the mounting flat down onto the tray, so that the tray assembly is rendered compact and thus easily stored as in the luggage bag itself.

The mounting in some embodiments is comprised of a pair of swing arms each extending outwardly to one side of a central structure, with strut engagement elements carried on the outer end of each of the swing arms. The swing arms may be urged outwardly to a normal fully separated position by springs acting thereon. In the fully separated position, the distance between the spaced apart outer ends with the engagement elements is substantially greater than the width of the space between the handle struts. By manually squeezing them together, the swing arms are able to be fit into the space between the handle struts.

The swing arms have inner ends pivotally attached to the central structure side of the tray and are each angled upwardly and outwardly from the pivotal attachment in opposite directions. Finger grips adjacent the engagement elements may be provided to allow a user to conveniently squeeze the swing arms together so as to be fit between the handle struts. The tray assembly is positioned at its desired position along the struts.

Upon subsequent release of the swing arms by the springs until the engagement elements each frictionally engage the inside of a respective one of the struts. This fixes the tray assembly to the struts at the desired height above the top of the luggage bag.

In a second embodiment, the swing arms are arranged to extend down from a central structure tray and also extending outwardly therefrom in opposite directions. Optionally, a holder piece may be installed on the central structure at one end and onto the luggage bag handle at the other end to resist any tendency for the tray assembly to slide down on the struts.

In the second embodiment, the swing arms are molded to be of a configuration which allows them to be resiliently deflected by a user when squeezing them together to be able to be fit into the space between the handle struts. This generates a restoring force by the ability of the deflected material of the swing arm to return to the same condition, when released. The swing arms acting on each swing arm thus will attempt to spread back apart and so the outer ends will engage the struts, and the swing arms to frictionally engage the struts. This causes the tray assembly to be held to the struts. This initial positioning of the tray assembly can be at any desired level.

The outward acting restoring force created when the swing arms are squeezed together may be augmented by separate springs, each engaging a respective swing arm and also acting to urge the swing arms to move outwardly. The addition of the springs increases the frictional retention forces developed when the engagement elements are in contact with the struts to establish a more secure connection.

In yet another embodiment, a pair of clamping plates are secured together with the extended handle struts between them to tightly grip the struts by advance of the threaded collar on a threaded post extending from one plate and through an opening in the other plate. The tray is preferably hinged to one of the plates to allow both of the plates to be folded down atop the tray bottom after removal from the struts.

A battery compartment can also be provided as a part of the central structure to which the swing arms are mounted, and a rechargeable battery may be disposed therein providing spare power for electronic devices whether supported on the tray or not.

DESCRIPTION OF THE DRAWING FIGURES

DETAILED DESCRIPTION

Figure 1:
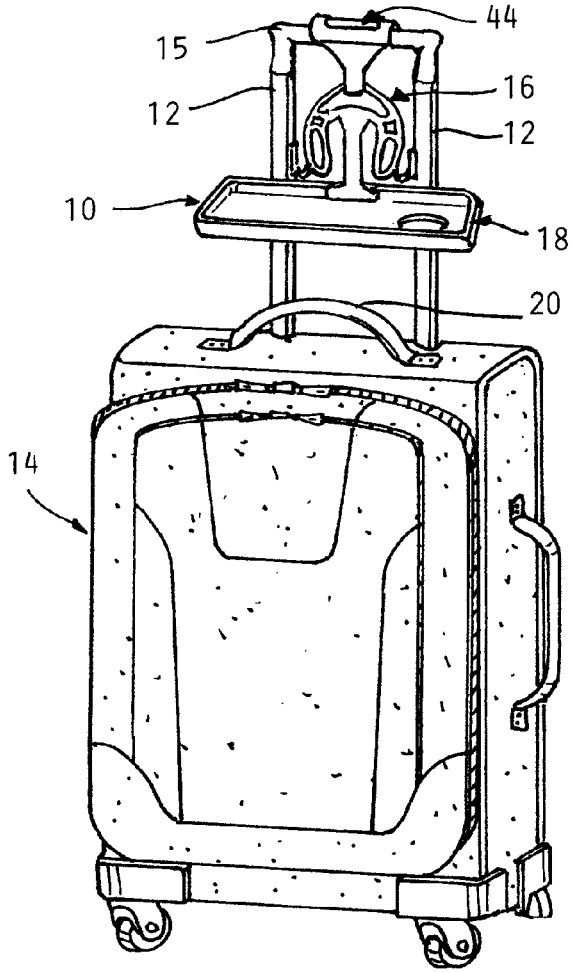
FIG. 1 is a pictorial view of a wheeled luggage bag having a tray assembly according to the present invention mounted thereto.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the Drawings, and particularly to FIGS. 1-5, a first embodiment of a tray assembly 10 according to the invention is shown mounted between the extended handle struts 12 of a wheeled luggage bag 14 at a location well above the top of the luggage bag and below the handle 15 itself.

The tray assembly 10 includes a support 16 extending vertically up from the back side of a rectangular tray 18 which projects horizontally over the top of the bag 14 above a lifting handle 20.

Figure 2:
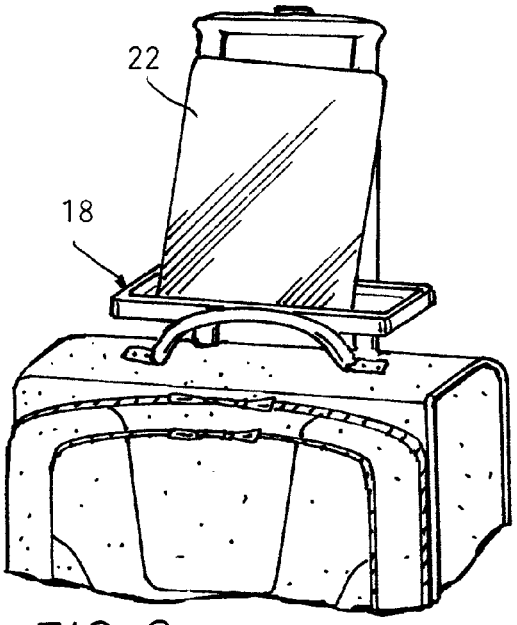
FIG. 2 is a pictorial view of the luggage bag shown in FIG. 1 with the tray assembly mounted thereto at a lower position so as to accommodate a large personal electronic device sitting on the tray.
Figure 3:
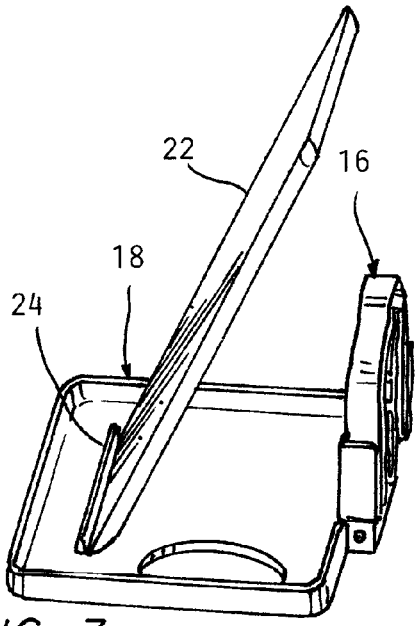
FIG. 3 is an enlarged pictorial view from the side of the tray assembly shown in FIG. 2 holding the personal electronic device.

FIGS. 2 and 3 show a tablet 22 resting on the tray 18, with a raised rib 24 locating the bottom of the tablet 22, the top leaning back to engage the struts 12 as seen in FIG. 2.

Figure 4:
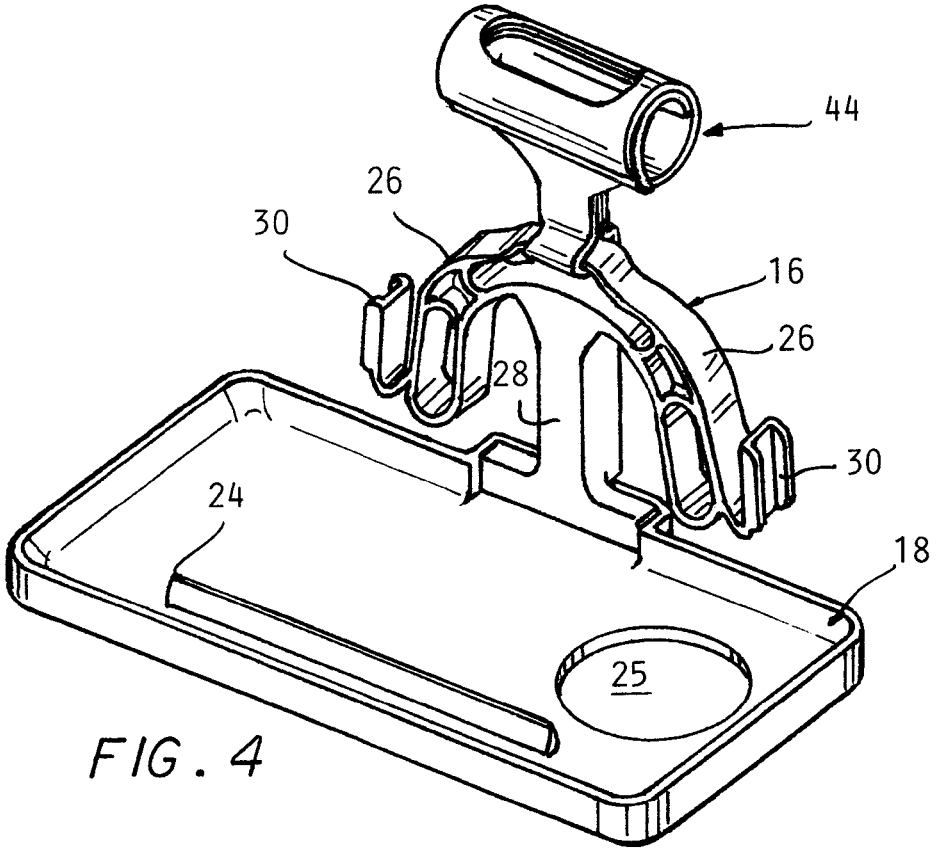
FIG. 4 is an enlarged pictorial view from the front of the tray assembly shown in FIG. 1.
Figure 4A:
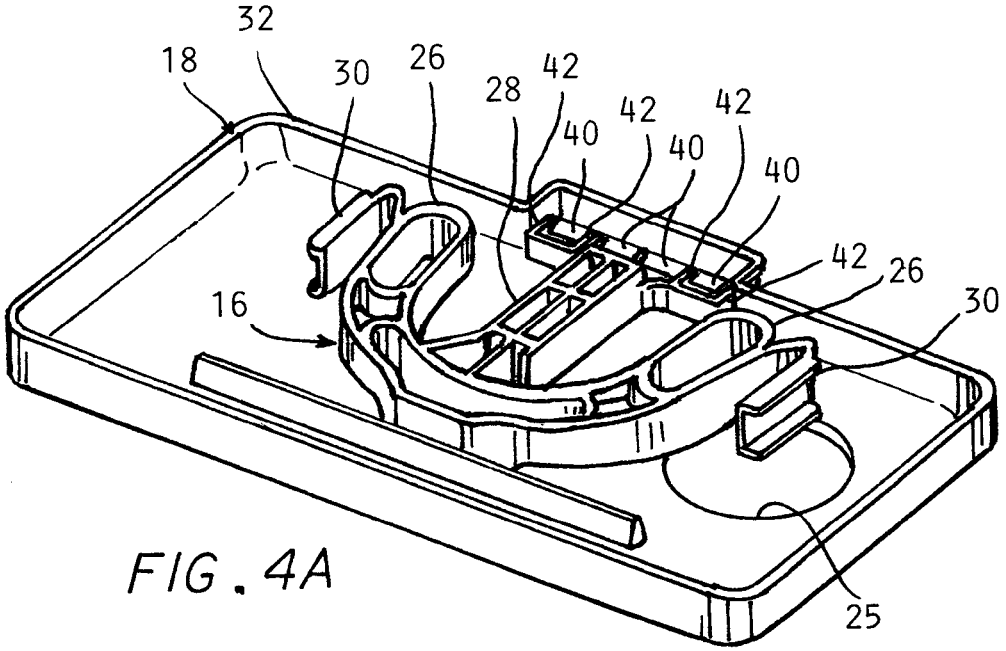
FIG. 4A is an exploded pictorial view of the tray assembly shown in FIG. 4.
Figure 4B:
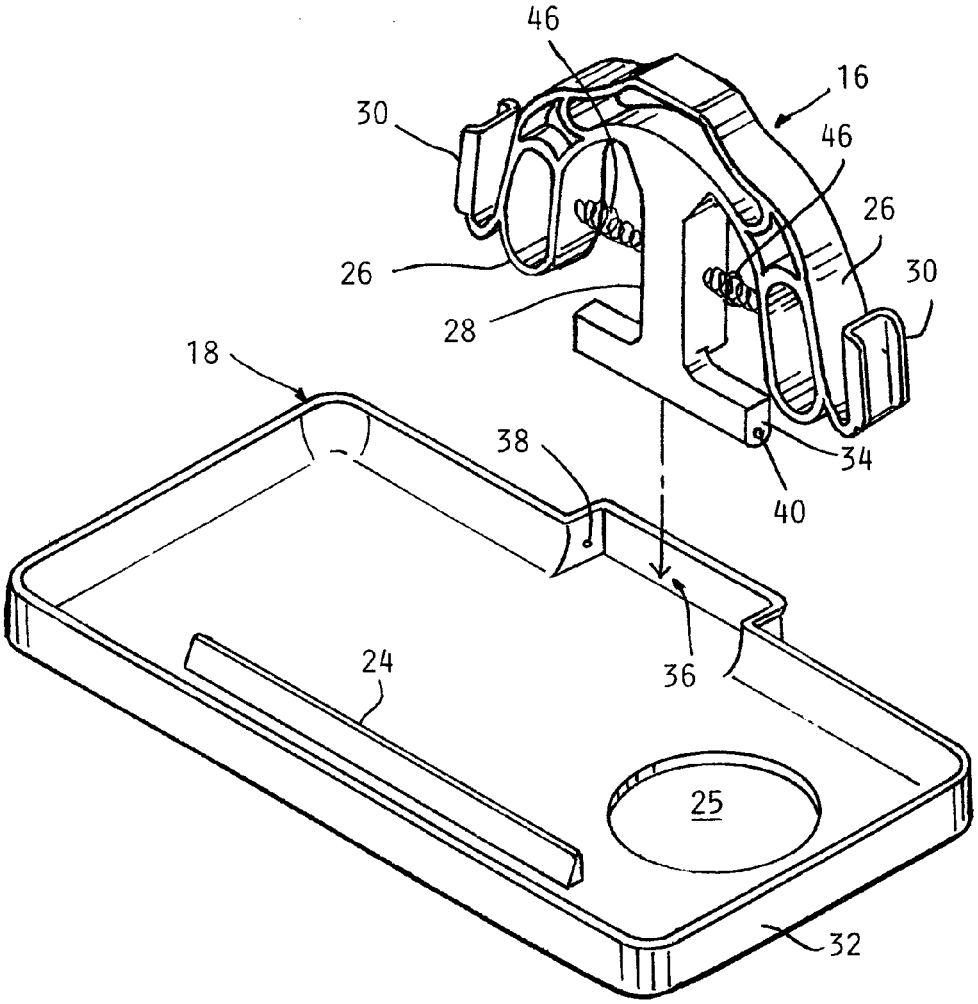
FIG. 4B is an enlarged pictorial view from the front of the tray assembly shown in FIGS. 4 and 4A with swing arms included therein folded down and a holder piece removed for storage.

Referring to FIGS. 4, 4A and 4B, the support 16 comprises a pair of swing arms 26 extending radially out from a central structure 28 and curving down from the top thereof. The swing arms 26 are preferably molded from a plastic or made from some other material which is resiliently bendable. The swing arms 26 may be molded to have hollows as shown so as to be bendable by hand in order to be compressed together. Restoring forces are generated when the swing arms are squeezed together by resiliency of the plastic material. The swing arms 26 when relaxed and in a fully spread apart condition have outer ends with engagement elements 30 thereon spaced apart a distance substantially greater than the space between the struts 12.

The swing arms 26 are squeezable together sufficiently to be able to fit between the handle struts 12 and placed at any desired height. When the swing arms 26 are released, they are spread apart by the restoring forces and the channel shaped engagement elements 30 move out to firmly frictionally engage a respective strut 12. This frictional engagement is sufficient to enable the swing arms 26 to be securely held at any selected height on the struts 12.

The tray 18 has an upright perimeter rim 32 to define a shallow enclosed space therein. The central structure 28 has a cross bar portion 34 which is pivoted at its ends to the wall of a U-shaped recess 36 in the tray perimeter with pins extending through holes 38, 40 to create a hinge allowing the support 16 to be swung down flat against the bottom of the tray 18 to be substantially enclosed within the rim 18 (FIG. 5) to minimize the size of the tray assembly 10 for convenient storage in the luggage bag 14.

Alternatively, spaced projections 40 and interposed blades 42 can provide a hinged connection between the central structure 28 and the tray 18 (FIG. 4A).

A detachable hanger piece 44 can optionally be hooked to the top of the central support 16 and to the handle 15 itself to keep the tray assembly 10 from sliding down on the struts 12 (FIG. 4).

Separate springs 46 (FIG. 4B) can optionally be used to increase the restoring forces and the frictional securement of the engagement elements 30 to the struts 12.

Figure 5A:
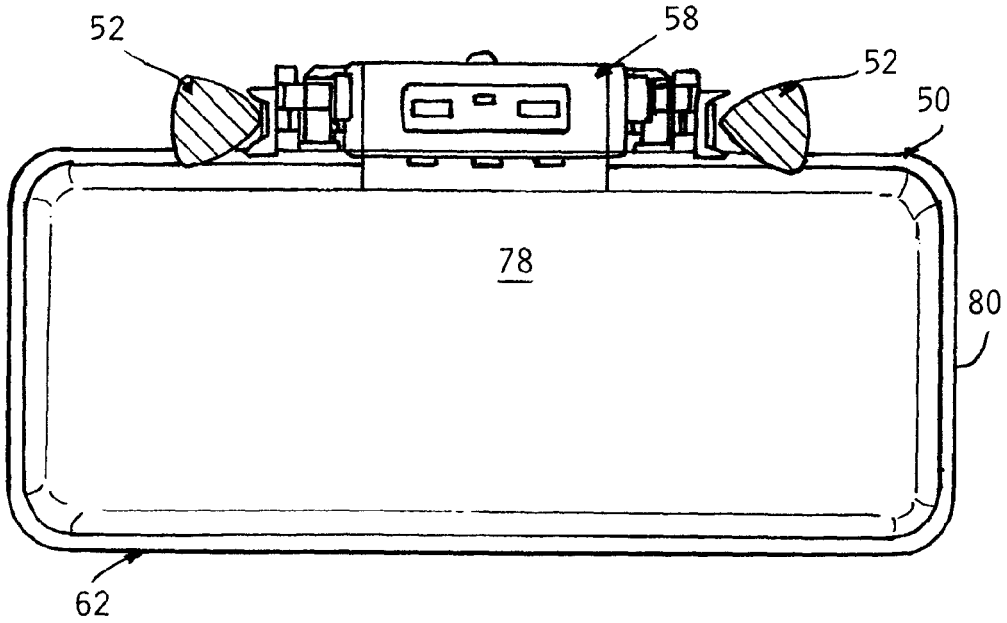
FIG. 5A is a top view of the tray assembly as shown in FIG. 5.
Figure 5:
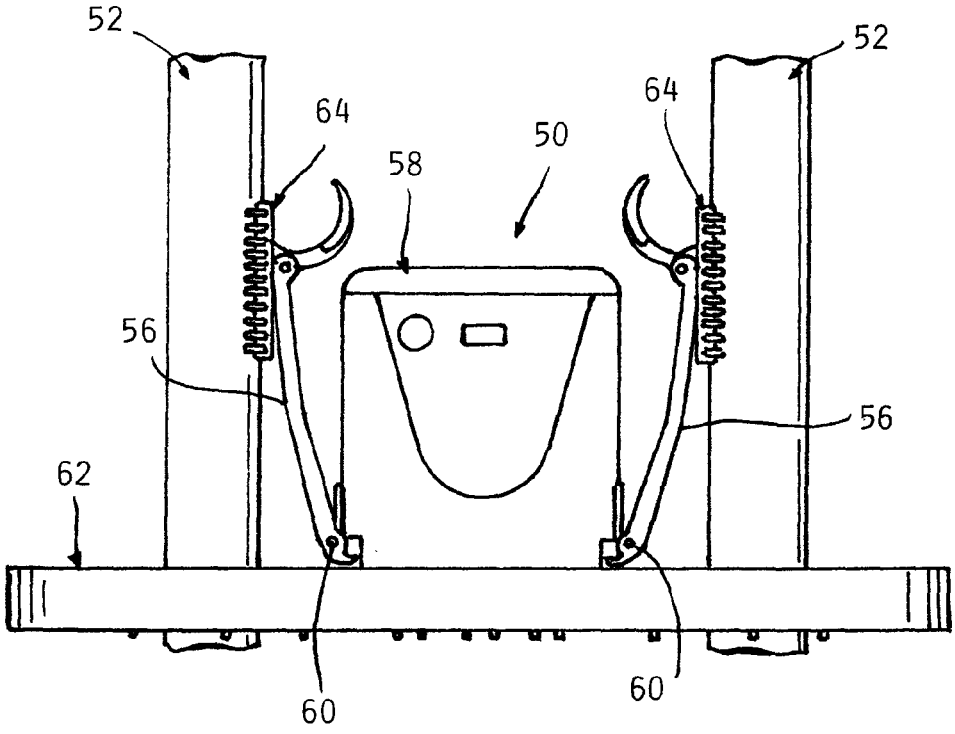
FIG. 5 is a pictorial view of a second embodiment of a tray assembly according to the present invention mounted to extended handle struts of the luggage bag.
Figure 5B:
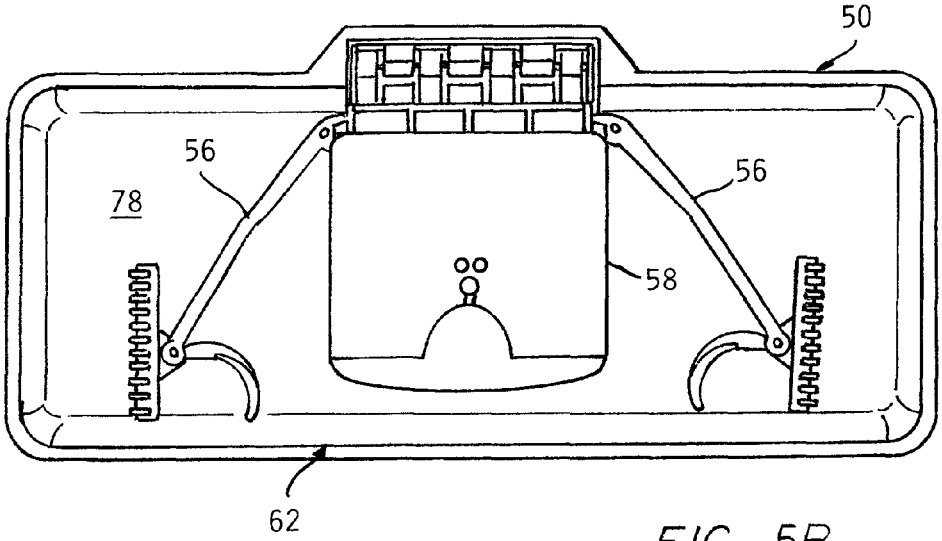
FIG. 5B is a top view of the tray assembly shown in FIG. 5 with the swing arms and central structure battery case folded down onto the tray to make the tray assembly more compact to facilitate storage.
Figure 5C:
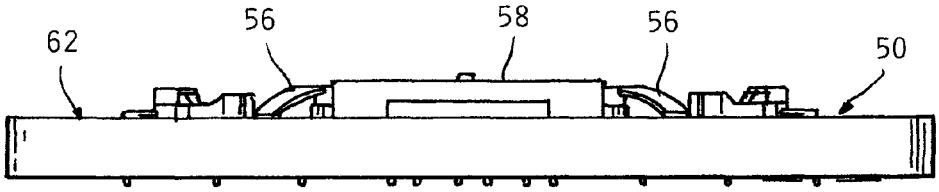
FIG. 5C is a front view of the tray assembly shown in FIG. 5B.
Figure 5D:
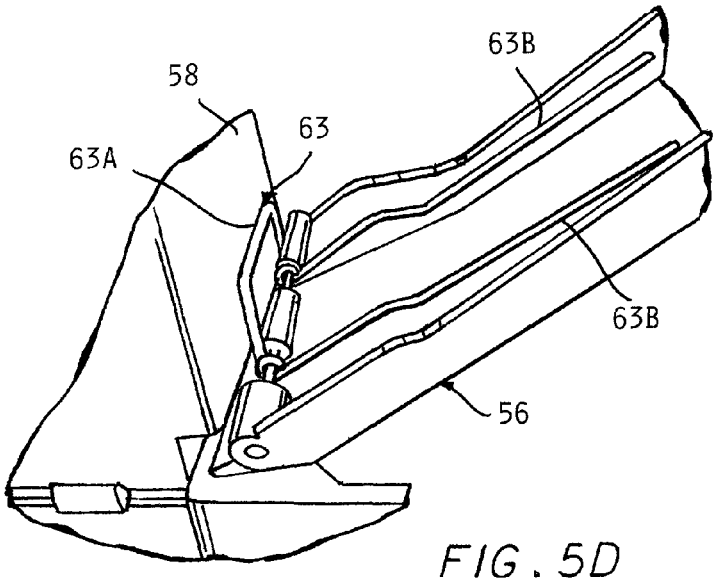
FIG. 5D is a fragmentary enlarged pictorial view taken from above of a part of the tray assembly shown in FIGS. 5-5C showing a wire form spring associated with a swing arm to create a restoring force urging the swing arm to swing out from a squeezed together condition.
Figure 6:
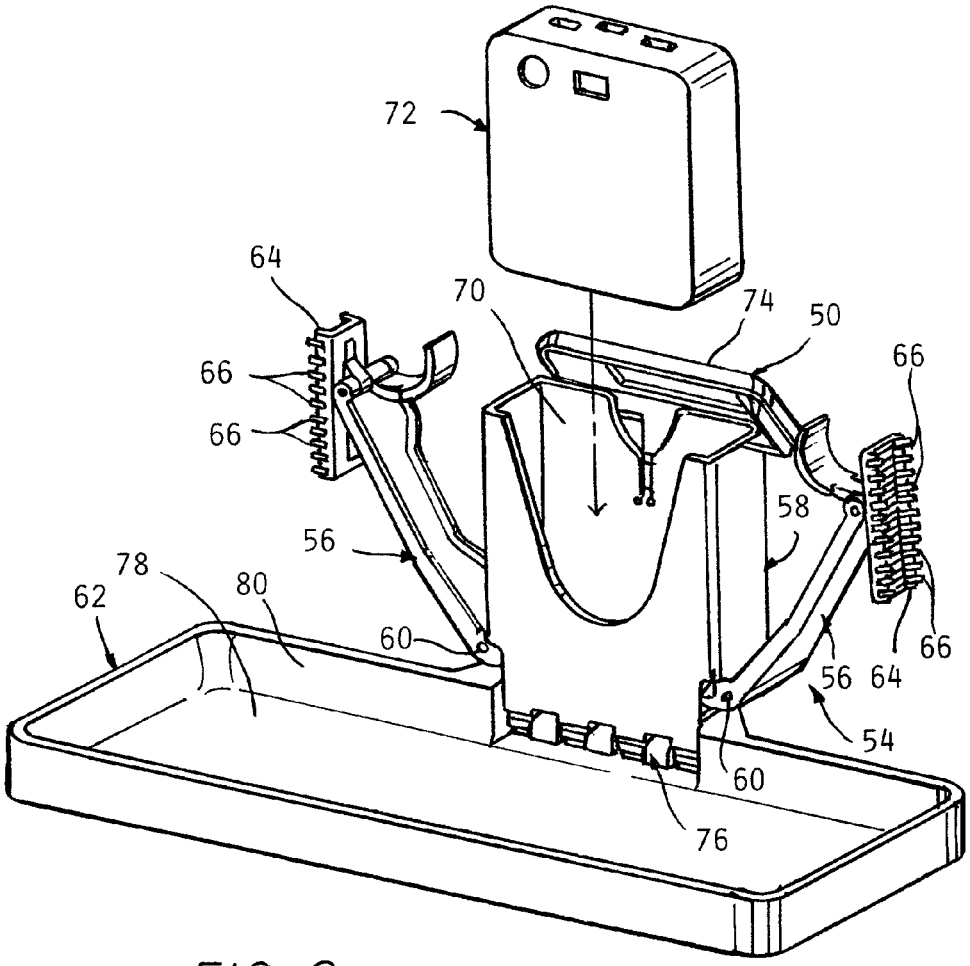
FIG. 6 is an enlarged exploded pictorial view of the tray assembly shown in FIG. 5.

FIGS. 5-5D show a second embodiment of a tray assembly 50 according to the invention which also is adapted to be quickly mounted between handle struts 52 and removed therefrom.

A support 54 is included which has a pair of swing arms 56 extending up from a central structure 58 and which also extend radially out from a pivot pin 60 connecting the inner end of each swing arm 56 to the central structure 58.

A rectangular tray 62 has a hinged connection 64 an one side to the central structure 58.

The swing arms 56 each have an engagement element 64 pivotably connected to the outboard end thereof allowing them to square up to the struts 52 when pressed against the inside surfaces of the struts 52. A series of rubbery inserts 66 on each engagement element 64 increase the friction with the struts 52.

Wire form springs 63 are wrapped around the pivot pins 60 with a middle reaction portion 63A bearing against the central structure 58 and a pair of ends 63B engaging the inside of the associated swing arms 56 (FIG. 5D). The springs 63 holds the swing arms 56 in a fully opened spread apart condition in which the ends are much wider apart than the distance between the struts 52 and resist any inward movement.

Restoring forces are thus generated when the swing arms 56 are squeezed together.

A finger grip 68 on the outer end of each of the swing arms 56 enables a user to conveniently squeeze the swing arms 56 together to be close enough together for the tray assembly 50 to be fit in the space between the struts 52 or for removing the same.

The central structure 58 may include a battery compartment 70 for storing a battery 72 which can be used as spare power for various personal electronic devices to supplement the power provided by their own built in batteries.

A hinged battery compartment cover 74 is preferably provided.

As noted above, the central structure 58 has a hinged connection 76 to the middle of one side of the tray 62. This allows the central structure 58, battery 72 and both swing arms 56 to be swung down into the tray interior space 78 defined by a tray rim 80 as seen in FIGS. 5B and 5C.

Figure 7A:
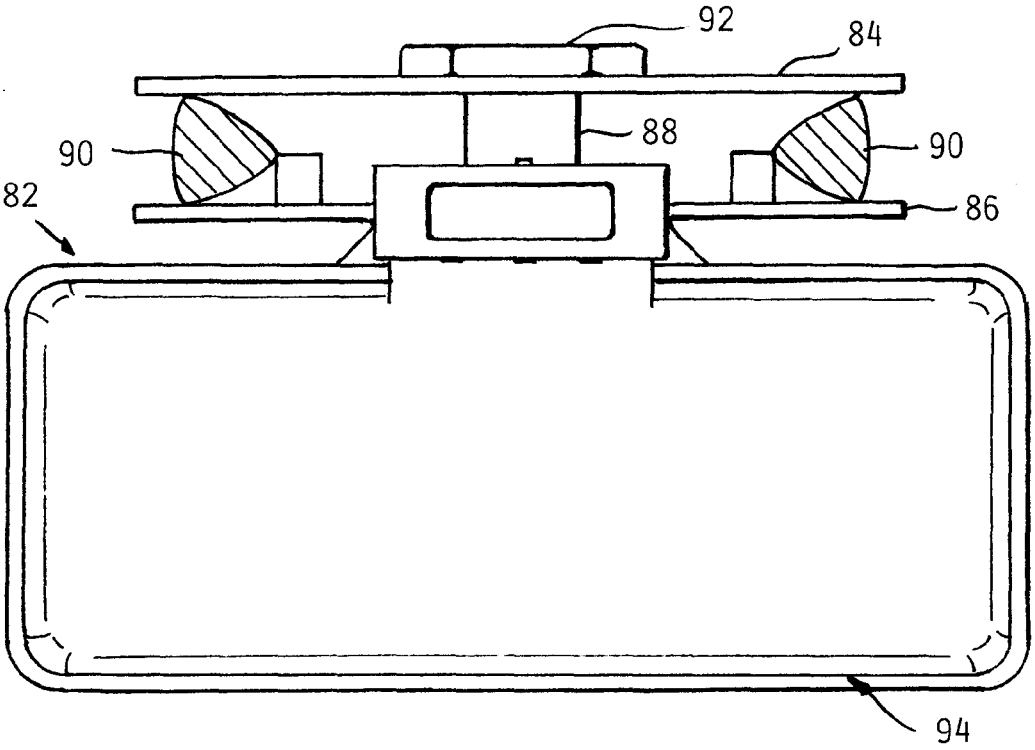
FIG. 7A is a front view of the tray assembly and handle struts as shown in FIG. 7.
Figure 7:
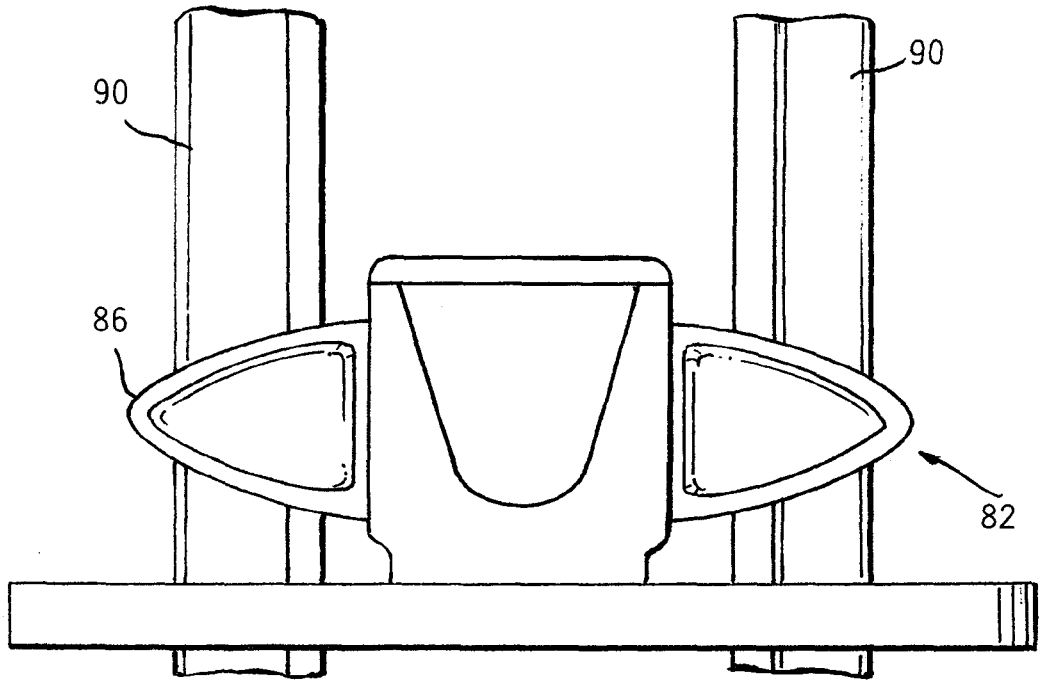
FIG. 7 is a plan view of a third embodiment of a tray assembly according to the present invention mounted to a pair of handle struts of a wheeled luggage bag.

FIGS. 7A and 7B show a third embodiment of a tray assembly 82 according to the invention which has a pair of clamping plates 84, 86. The rear plate 84 is slidably received onto a threaded plug 88 so as to be able to be moved towards the front plate 86. The wheeled luggage bag handle struts 90 are disposed between the clamping plates 84, 86 so that when a finger nut 92 threaded onto the plug 88 it will force the rear plate 84 against the struts 82 to be clamped to the struts 94 at any height desired.

Thus, the tray assembly can be quickly installed onto the handle struts of wheeled luggage bag without any tools or knobs to turn knobs makes it quite unique.

Once installed, the tray can prop mobile devices such as tablets, mobile phones, headphone, etc. and can also hold other lightweight items such as a person's lunch, games, etc.

That tray assembly holds devices for reading and surfing at a convenient selected level.

Detaching from the tray assembly from bag luggage is very quick and done by simply squeezing the clamping arms with two fingers, then pulling the device away from the luggage handle struts.

A power bank battery may or may not be permanently integrated into the tray assembly.

The tray assembly may or may not include mechanical features (groove, ledge, etc.) for supporting device such as a tablet or mobile phone.

The invention claimed is:

1. A tray assembly in combination with a luggage bag having a pair of spaced apart handle struts, of which pair of struts may be moved from a retracted position within said luggage bag to an extended position above a top of said wheeled luggage bag, said tray assembly located between said handle struts and including:

a tray defining a flat surface for placing items thereon;

a mounting arrangement connected to said tray and including a pair of engagement elements spaced apart a greater distance than a space between said handle struts and extending away from each other, said mounting arrangement further including an upright intermediate central structure attached to one side of said tray, said tray extending generally normally from said intermediate structure, said engagement elements having outer ends manually movable by a user towards each other to reduce the spacing between said outer ends thereof so as to be able to be fit between said handle struts; a resilient resistance force generating arrangement creating a restoration force urging said outer ends of said engagement elements to move outwardly away from each other so as to cause said outer ends to frictionally engage an inner surface of a respective one of said handle struts when said outer ends are released after being manually moved together, to thereby frictionally engage an inner surface of a respective one of said struts; said tray thereby supported on said luggage bag handle struts at a selected level thereon above the top of said luggage bag.

2. The combination according to claim 1 wherein said engagement elements each comprise an elongated swing arm, each swing arm including an inner end and an outer end, each of said inner ends pivotally attached to said central structure, each of said outer ends normally located spaced away from a respective side of said central structure and extending outwardly therefrom, said swing arms each pivotable about an associated inner end thereof, said force generated by said resilient resistance force generating arrangement resisting manual movement of said swing arm outer ends together and comprising a restoring force generated when said swing arms are pivoted towards each other, whereby after said swing arms are pivoted inwardly to be located between said handle struts and thereafter released, said restoring force causes said swing arm outer ends to swing out to bring said outer ends into frictional engagement with said inside surface of a respective handle strut, said frictional engagement creating a frictional retention of said tray assembly in a position along said struts sufficient to hold said tray in a vertical position on said struts.

3. The tray assembly according to claim 2 wherein said inner end of each of said swing arms being pivotally connected to said central structure to enable said inward and outward swinging motion of said swing arms thereon and further including a pair of springs included in said resilient resisting force generating arrangement, each spring acting on a respective swing arm to to resist said pivoting movement of said swing arms together and thereby generating said restoring force generated by said resisting force generating arrangement when said swing arms are pivoted towards each other.

4. The tray assembly according to claim 1 wherein said central structure is pivoted at a lower end to one side of said tray to be able to be manually pivoted to a position extending up from said tray to a position folded down over said tray for convenient storage of said tray assembly.

5. The tray assembly according to claim 1 further including a hanger piece connected to an upper end of said central structure and hooked to an upper bag handle cross piece extending between upper ends of said handle struts and connected thereto to prevent said tray assembly from sliding down said handle struts.

* * * * *